US007886873B2

(12) United States Patent
Kurath-Groll Mann et al.

(10) Patent No.: US 7,886,873 B2
(45) Date of Patent: Feb. 15, 2011

(54) PANEL-TYPE CONSTRUCTION ELEMENT

(75) Inventors: Josef Peter Kurath-Groll Mann, Winterthur (CH); Walter Roland Weiler-Bisig, Cham (CH)

(73) Assignee: SwissFiber AG, Zurich (CH)

( * ) Notice: Subject to any disclaimer, the term of this patent is extended or adjusted under 35 U.S.C. 154(b) by 725 days.

(21) Appl. No.: 10/544,705

(22) PCT Filed: Feb. 6, 2003

(86) PCT No.: PCT/CH03/00092

§ 371 (c)(1),
(2), (4) Date: Apr. 13, 2006

(87) PCT Pub. No.: WO2004/070135

PCT Pub. Date: Sep. 18, 2004

(65) Prior Publication Data

US 2006/0207216 A1 Sep. 21, 2006

(51) Int. Cl.
*E04G 5/08* (2006.01)

(52) U.S. Cl. ..... 182/222; 182/119

(58) Field of Classification Search ..... 182/119, 182/222, 223

See application file for complete search history.

(56) References Cited

U.S. PATENT DOCUMENTS 1,592,109 A * 7/1926 Jacobs ..... 182/176
2,261,831 A * 11/1941 Farr et al. ..... 182/223
3,042,453 A * 7/1962 Lyon ..... 301/37.31
3,434,567 A * 3/1969 Wilkins ..... 182/222
3,884,328 A * 5/1975 Williams ..... 182/222
4,369,716 A * 1/1983 Munk et al. ..... 108/57.28
4,531,695 A * 7/1985 Swinfield ..... 244/119
D281,106 S * 10/1985 Thomas et al. ..... D25/68
4,806,077 A * 2/1989 Bost ..... 416/226
5,145,430 A * 9/1992 Keys et al. ..... 441/74

(Continued)

FOREIGN PATENT DOCUMENTS

CH 529 276 A 10/1972

(Continued)

OTHER PUBLICATIONS

International Search Report; International Application No. PCT/CH 03/00092; Date of Mailing: Oct. 9, 2003.

*Primary Examiner*—Alvin C Chin-Shue
(74) *Attorney, Agent, or Firm*—Antonelli, Terry, Stout & Kraus, LLP.

(57) ABSTRACT

A panel-type construction element comprises a substantially rectangular base panel (1), which is particularly suited, for example, for use as a covering for facade scaffolding. Numerous dimples (2) can preferably be configured on the upper face of the base panel parallel to the longer side of the panel and continuous transversal areas (3) that are devoid of dimples and that respectively run at intervals in the longitudinal direction of the base panel are configured over the entire width of the latter. In the areas (3), transversal ribs (7), which project downwards and are connected to the underside and the respective abutting areas of flange surfaces (4) provided on the underside of the base panel to project downwards from the two longer sides of the base panel. The combination of longitudinal and transversal elements permits a simple, rigid and light-weight construction element, which if configured in plastic exhibits excellent weather and corrosion-proof properties and is extremely stable.

7 Claims, 2 Drawing Sheets

U.S. PATENT DOCUMENTS 5,161,640 A * 11/1992 Holbrooks et al. ..... 182/92
D337,211 S * 7/1993 Bergkvist ..... D6/349
5,749,555 A * 5/1998 Albrecht ..... 248/346.01
6,467,117 B1 * 10/2002 Lantz et al. ..... 14/6

FOREIGN PATENT DOCUMENTS

DE 37 05 566 A 9/1988
DE 4135888 A1 * 5/1993
FR 2633582 A1 * 1/1990
GB 2033290 A * 5/1980
NL 8 501 367 A 12/1986

* cited by examiner

PANEL-TYPE CONSTRUCTION ELEMENT

RELATED APPLICATION

This application is a U.S. national stage application filed under 35 U.S.C. §371 of international application no. PCT/CH2003/000092 filed Feb. 6, 2003.

TECHNICAL FIELD

The invention relates to an element of construction having a substantially rectangular base plate.

BACKGROUND

In building construction particularly, board-shaped elements of construction are employed as part of the façade scaffolding. A plurality of application classes, defined by the size (width of the board), working load and intended purpose among other factors, are distinguished. Because a façade scaffolding is a temporary structure, these scaffoldings are usually of modular construction; that is, virtually any scaffolding design can be put up with a small number of uniformly constructed elements (ledgers, bearers, and boards).

The board-shaped elements of construction ordinarily have a length of 250 cm and a width between 60 cm and 90 cm. As a rule, they are used for all application classes. They experience loading primarily in flexure but, in addition, must also be able to handle individual concentrated loading cases.

Elements of wood, a wood-aluminum composite, aluminum, or steel are conventionally used for the boards. All these materials, however, have specific disadvantages.

Wood elements, for example, absorb water, which can lead to externally invisible rotting, in particular of the wood core, and unforeseeable fracturing of the board element. In order to avoid this sudden failure due to water absorption, such wooden boards must be inspected periodically. The lifetime or service life of such board elements is thus greatly limited. Water absorption further leads to a gain in the weight of these board elements, which on the one hand has a disadvantageous impact on the handling of the elements when scaffoldings are being erected or dismantled at the construction site and on the other hand increases the dead weight of the scaffolding, leading to a reduction in the working load.

In the case of composite or hybrid wood-aluminum boards, while the dead weight is reduced in comparison with the plain wood board, the same disadvantages in terms of water absorption are present as in the previous case. Along with the danger of failure due to water absorption, here there is a further possibility of failure of the welds in the aluminum frames.

Plain aluminum boards in comparison with composite or hybrid boards do not exhibit any major differences in terms of weight but are not susceptible to water absorption. Such boards, however, have very poor fatigue properties with respect to the danger of failure of the welds, which again means that the lifetime is limited. Boards currently available on the market also have a low resistance to skidding, which has a disadvantageous impact on safety.

All conventional boards have a high specific weight, which has a disadvantageous impact particularly on handling, that is, assembly, dismantling, transport and storage.

In order to address these disadvantages, trials with alternative materials have also been carried out. In particular, boards have been fabricated from fiber-reinforced plastic, which led to lower weights and better environmental stability in comparison with conventional boards. As a rule, however, plastics exhibit an unfavorable modulus of elasticity, so that either the required properties could not be attained or else very thick boards resulted.

Thus from DE 37 05 566 there is known a facade scaffolding having such a board having narrow, downwardly extending flange surfaces along two opposite sides, the board having longitudinal and/or transverse fins on its underside. In order to attain adequate strength, however, these boards need a steel frame arranged thereunder and having ledgers on which the lateral edges of the boards or the flange surfaces can rest.

SUMMARY

It was a goal of the present invention to furnish such a board-shaped element of construction that would, at the lowest possible weight, be able to accommodate the required flexural loads.

According to the invention, this goal is achieved with an element of construction having a substantially rectangular base plate, characterized in that there are fashioned flange surfaces extending downwardly from both longer sides of the base plate and on the underside of the base plate there is fashioned at least one transverse rib extending downwardly and connected to the underside and to respectively abutting regions of the flanges surface.

Further preferred embodiments arise from the features disclosed herein.

By fashioning the element with a flat compression chord and lateral tension chords, it is possible to attain a high flexural strength with a slight wall thickness, which advantageously leads in the end to low weight of the element along with small dimensions. Fashioning the element with transverse ribs arranged beneath the base plate permits the construction of a base plate of relatively slight thickness.

In a preferred embodiment, dimples are fashioned in the surface, planar transverse regions being left to reinforce the transverse ribs arranged beneath the base plate, the dimples permitting the construction of a base plate of relatively slight thickness. Here the use of plastic, preferably fiber-reinforced plastic, results in a stiffness satisfying the requirements.

The dimples are advantageously fashioned only deep enough that the stiffening action is sufficient but no disadvantages arise in terms of the serviceability of the element of construction. This means in particular the suitability of the element of construction as a surface for walking on, which is not to be impaired by excessively deep or upwardly protruding elements.

Through the use of carbon-fiber-reinforced plastic elements such as for example carbon-fiber-reinforced plastic strips, the tensile loading of individual regions of the element of construction can be increased in a controlled way without any substantial effect on—that is, gain in—the dimensions or weight. These reinforcements are preferably affixed in the region of the maximal tensile loads, that is, on the undersides of the transverse ribs and the lower regions of the two external flanges.

By virtue of the preferred fashioning of the connecting elements as downwardly open profiled members having a rounded cross section, the elements of construction are easily connected to one another as well as for example to cross-rails of scaffolding structures. Of course, any other connecting elements can also be affixed on the transverse sides of the element of construction so as to correspond to the intended use and fashioning of the corresponding connectors of, for example, the scaffolding structure. Preferably in the form of elements fashioned in the shape of hooks, which are connected for example to the flanges of the element of construction and extend therefrom in the longitudinal direction.

BRIEF DESCRIPTION OF DRAWINGS

In what follows, exemplary embodiments of the invention are explained in greater detail with reference to the drawings, in which.

DETAILED DESCRIPTION

Figure 1:
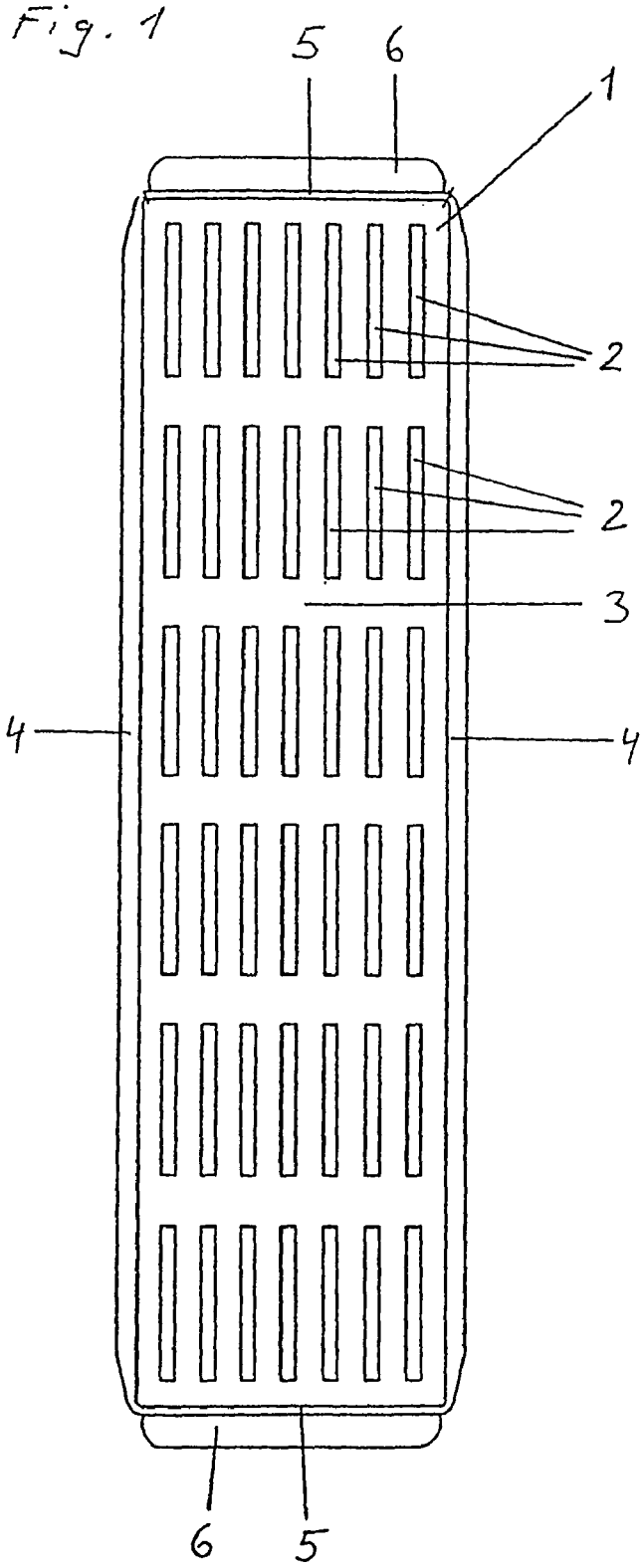
FIG. 1 is a schematic top view of an element of construction according to the invention having dimples fashioned in the surface.
Figure 2:
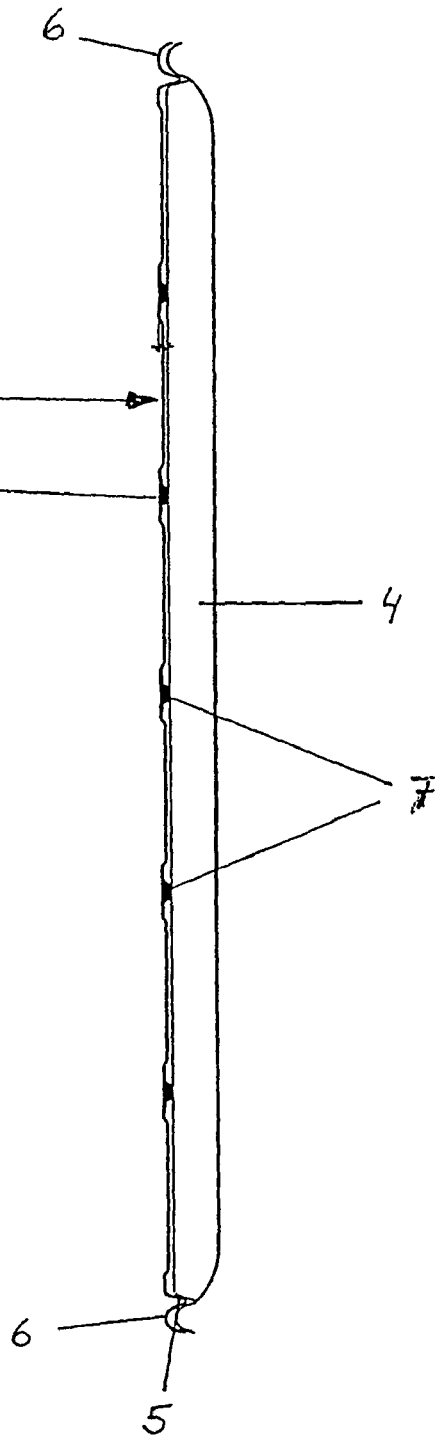
FIG. 2 is a longitudinal section through the element of construction of FIG. 1.

FIG. 1 is a top view, and FIG. 2 a longitudinal section, of an element of construction embodied according to the invention. The substantially rectangular top side of base plate 1 here preferably has a large number of dimples 2, which advantageously all have the same length and width. Dimples 2 are arranged side by side in parallel groups regularly spaced over the entire width of base plate 1. Transverse regions 3 free of dimples or other elevations or depressions are fashioned between groups of dimples 2 spaced apart in the longitudinal direction of base plate 1.

From base plate 1, flange surfaces 4 extend downwardly along both longitudinal sides. Flange surfaces 4 are advantageously rounded at the ends, as can be inferred in particular from FIG. 2. Downwardly angled flanges 5, which are smaller in height than flange surfaces 4, also extend on the transverse sides of base plate 1. Flanges 5 exhibit outwardly protruding connecting elements, here in the shape of downwardly open profiled members 6.

These profiled members 6 can now be suspended or laid, for example, on cross-rails of scaffolding structures (not depicted). These profiled members 6 belonging to elements of construction succeeding one another in the longitudinal direction can be arranged engagingly one over another, and in this way for example connected in common to a cross-rail.

On the underside of transverse regions 3, transverse ribs 7 extending over the entire width of base plate 1 are now fashioned. The ends of these transverse ribs 7 make a transition directly into flange surfaces 4 or are connected to these. Buckling of flange surfaces 4 under loading of base plate 1 is avoided in this way.

By virtue of this embodiment of the element of construction, a stiff board-shaped element can be created from relatively thin material. Base plate I with dimples 2 serves as the compression chord and the two flange surfaces 4 as tension chord of the element.

Such an element of construction can advantageously be fabricated from plastic, which leads on the one hand to an advantageous resistance to weathering and on the other hand exhibits high stiffness together with light weight on account of the shaping according to the invention. In this way, such elements of construction are particularly good to handle and are suitable in particular for use as weight-bearing boards for scaffoldings.

Figure 3:
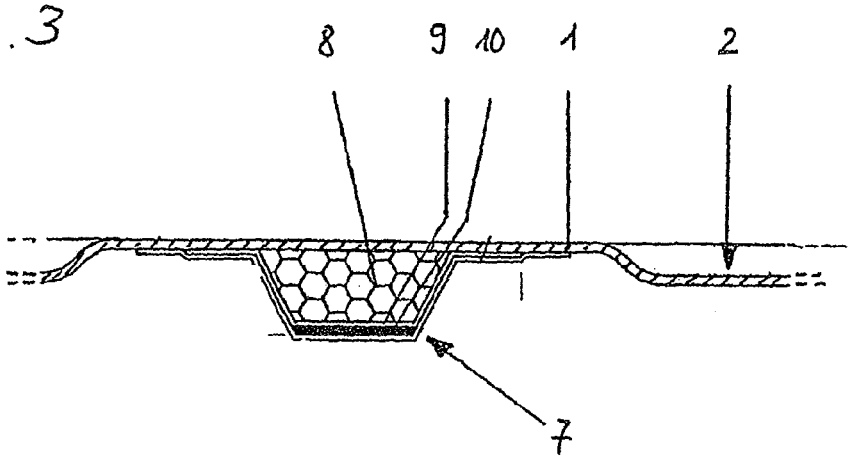
FIG. 3 depicts in closer detail a longitudinal section through the element of construction of FIG. 1 in the region of a transverse rib.

In FIG. 3 a longitudinal section of the element of construction in the region of transverse ribs 7 is depicted in closer detail. The depiction makes clear how remaining transverse region 3, which extends over the entire width of plate 1, is fashioned. Arranged beneath this transverse region 3 is transverse rib 7, which on the one hand is directly connected to the underside of base plate 1 and has both its ends directly connected to flange surfaces 4.

Transverse rib 7 advantageously has a porous core 8, for example of honeycomb construction. This core can be surrounded by a cover layer 9, preferably made of plastic. This layer can be fashioned as a single or multiple layer. Additionally, a reinforcement 10 of carbon-fiber-reinforced plastic can be attached, advantageously to the underside of transverse rib 7 as depicted in FIG. 3. In this way the tension region of transverse rib 7 is reinforced without any substantial increase in cross section or weight.

Transverse rib 7 advantageously has a trapezoidal cross section, which on the one hand guarantees optimal transmission and accommodation of forces and on the other hand is simple and thus favorable in terms of fabrication.

Figure 4:
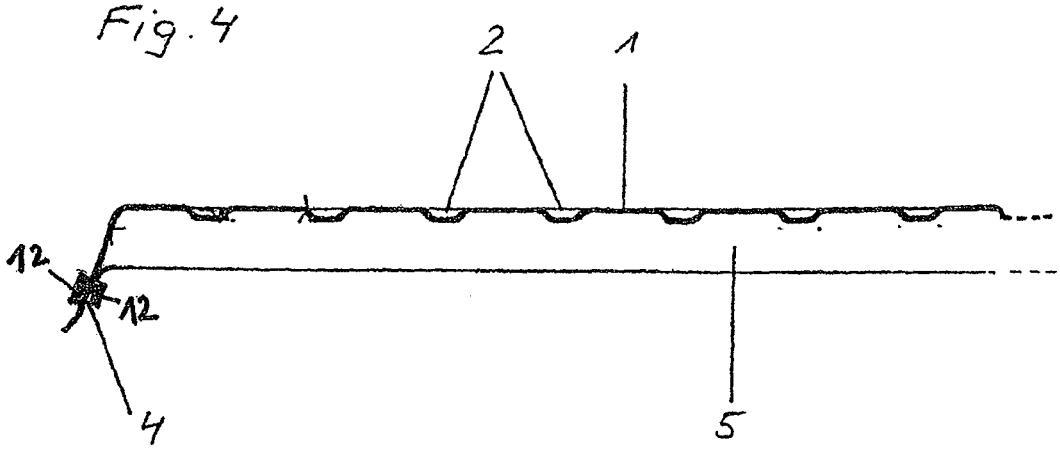
FIG. 4 is a cross section of the element of construction of FIG. 1.
Figure 5:
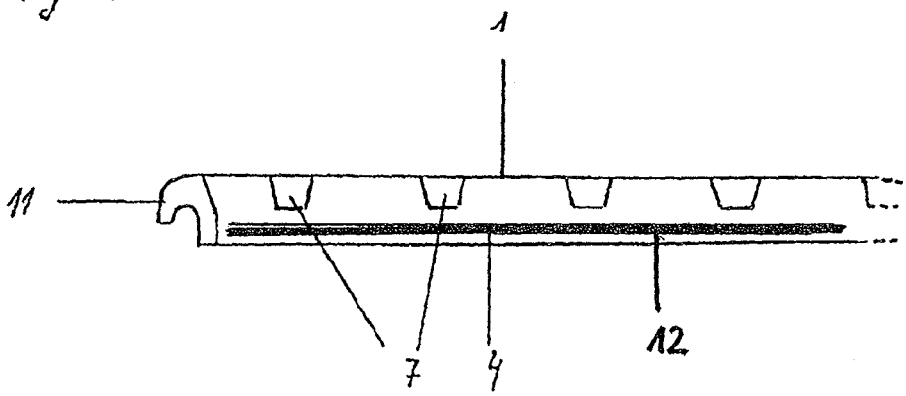
FIG. 5 is a longitudinal section through an alternative element of construction according to the invention having connecting elements in hook shape.

Further, flange surfaces 4 can also have reinforcements 12, FIGS. 4 and 5, of carbon-fiber-reinforced plastic, in particular in the lower region, in order to enhance the stiffness and ability to handle tensile loading. In this way, the maximal permissible loading and working load of the element of construction can be set in accordance with requirements.

Also depicted, in FIG. 4, is a cross section through an element of construction fashioned according to the invention, from which the fashioning of dimples 2 can be understood particularly well. In addition, flange surfaces 4 have an additional bend, in the present case directed toward the outside, in their lower region. This bend substantially enhances the buckling stiffness[1] of the flange surfaces, leading to greater stability and stiffness of the element of construction. The fashioning with the bend also makes it possible to stack the scaffolding decks on one another without difficulty. The out bottom flange region, on the one hand, provides a position detention in the transverse direction and, on the other hand, permits stacking.

On page 8, lines 25-26, the original reads Knick-resp. Beulsteifigkeit, where Knicksteifigkeit and Beulsteifigkeit are synonyms meaning "buckling stiffness."—Translator.

Naturally, the element of construction can also be fashioned without dimples 2, with a substantially planar surface 1. The surface can now preferably be provided with a skid-resistant coating, which substantially enhances the safety of the element of construction specifically in scaffolding construction.

For example, a longitudinal section through such an element of construction is depicted in FIG. 5, where the surface of base plate 1 is substantially planar and transverse ribs 7 are arranged thereunder spaced apart from one another at regular intervals. Further, the fashioning of the connecting element in the shape of a hook 11 is depicted schematically here. This hook 11 is advantageously fabricated of metal and connected to flange surface 4. Of course, any connecting element suitable for being connected to the corresponding supporting structure can be arranged on this end face of the element of construction. In particular, the specific connecting systems of various scaffolding systems can be affixed to or incorporated into the end face of the element.

The combination of longitudinal and transverse elements according to the invention results in a simple, flexurally stiff, and lightweight element of construction that can be fabricated from fiber-reinforced plastic. These materials are easy to process and exhibit especially good weathering and corrosion properties together with high stability and light weight. When used as deck elements for façade scaffoldings, such elements of construction are distinguished by their advantageous properties with respect to storability and transport, as well as by rapidity in handling. Further application fields therefore lie in the construction of exhibits and stages and in the façade aspect of building construction.

The invention claimed is:

1. A board-shaped element of construction made of plastic for facade scaffolding comprising a substantially rectangular base plate having a length suitable for use as a weight-bearing board for a scaffolding in building construction, the base plate having at least one substantially planar transverse region extending between both longer sides of the base plate, an external flange extending downwardly from the outermost edge of each of both longer sides of the base plate and on the underside of the base plate at least one transverse rib extends downwardly directly beneath a substantially planar transverse region of the base plate, the transverse rib being connected to the underside of the base plate and to respectively abutting regions of the external flanges, wherein the external flanges serve as tension chords of the element when the element is used as a weight-bearing board for facade scaffolding, the height of the external flanges is greater than the height of the transverse rib, and the transverse rib has a trapezoidal cross section narrowing in the downward direction; and wherein individual regions of the plastic element of construction subject to tension loading on the underside of the at least one transverse rib and the lower region of the external flanges are locally reinforced with tensile loading reinforcement elements; wherein the external flanges extend downwardly and outwardly from the longer sides of the base plate at an angle between 60° and 80° from the plane of the base plate, and their corner regions are rounded; wherein as said reinforcement elements the external flanges in lower regions thereof have at least one of inserts and reinforcements made of a material selected from the group consisting of carbon-fiber-reinforced plastic and strips of carbon-fiber-reinforced plastic, and further comprising connecting elements extending in the longitudinal direction of the base plate and arranged on the shorter sides of the base plate; wherein the connecting elements comprise substantially a downwardly open profiled member of semicircular cross section, fashioned over the entire width of the base plate and connected to the external flanges.

2. The element of construction of claim 1, further comprising in the top side of the base plate, parallel to the longer side of the base plate, a plurality of groups of dimples, each group of dimples having regularly spaced dimples arranged parallel to one another in the transverse direction of the base plate, the plurality of groups of dimples being arranged at regular intervals in the longitudinal direction with respective ones of a plurality substantially planar transverse regions extending from side to side at intervals in the longitudinal direction of the base plate between adjacent groups of dimples.

3. The element of construction of claim 2, wherein the width of the dimples is at most approximately 5% of the width of the base plate, the length of the dimples is at most approximately 20% of the length of the base plate, and the depth of the dimples is at most 50% of the depth of the at least one transverse rib.

4. The element of construction of claim 1, wherein the connecting elements comprise metal elements fashioned in hook shape.

5. The element of construction of claim 1, wherein as said reinforcement elements the at least one transverse rib in a lower tension region thereof has a reinforcement of carbon-fiber-reinforced plastic and is of sandwich construction with a porous core.

6. The element of construction of claim 2, wherein the top side of the base plate, at least regionally, is covered with a skid-resistant coating.

7. The element of construction of claim 1, wherein the external flanges have a bend directed toward the outside in their lower regions.

* * * * *